United States Patent [19]

Thomassen

[11] Patent Number: 4,954,234

[45] Date of Patent: Sep. 4, 1990

[54] DRUM ELECTROLYSIS

[75] Inventor: Thomas Thomassen, Brekkesto, Norway

[73] Assignee: Cheminvest A.S., Norway

[21] Appl. No.: 437,546

[22] Filed: Nov. 16, 1989

Related U.S. Application Data

[62] Division of Ser. No. 294,145, Dec. 19, 1988.

[51] Int. Cl.[5] ..... C25C 7/00

[52] U.S. Cl. ..... 204/212

[58] Field of Search ..... 204/212

[56] References Cited

U.S. PATENT DOCUMENTS

| | | | |
|---|---|---|---|
| 3,974,049 | 8/1976 | James et al. | 204/106 |
| 4,159,235 | 6/1979 | Kammel et al. | 204/272 |
| 4,172,780 | 10/1979 | Kammel et al. | 204/213 |
| 4,643,819 | 2/1987 | Heroguelle | 204/269 |

FOREIGN PATENT DOCUMENTS

| | | |
|---|---|---|
| 0129523 | 12/1984 | European Pat. Off. . |
| 0151055 | 8/1985 | European Pat. Off. . |
| 2031615 | 6/1969 | Fed. Rep. of Germany . |
| DE114624 | 8/1975 | Fed. Rep. of Germany . |
| 1252057 | 8/1986 | U.S.S.R. . |

OTHER PUBLICATIONS

"Nickelfeinstein-Elektrolyse mit Partikelelektroden"; pp. 401–407; see page 402, center column and FIG. 3; Metall 35 (1981).

"Elektrolytische Metallruckgewinnung in Elektrolysezellen mit bewegter Schuttgutkatode"; pp. 451–455; see p. 452, FIG. 1 and column 2, line 46; p. 453, column 1, line 9: Chem Techn 36 (1984).

*Primary Examiner*—T. M. Tufariello

*Attorney, Agent, or Firm*—Andrus, Sceales, Starke & Sawall

[57] ABSTRACT

Electrolysis of metal from an electrolyte inside a rotating cathode drum during use of an in the drum existing solid, freely movable insoluble particle material, provides that electrolyted metal does not deposit on the drum walls but on the present particulate material.

6 Claims, 2 Drawing Sheets

DRUM ELECTROLYSIS

This is a division of application Ser. No. 07/294,145, filed Dec. 19, 1988.

The present invention concerns a process for electrolysis wherein there is used a movable electrode in addition to one loose and freely moving solid medium present in the electrode, and a device for performing the process.

It is previously known to perform electrolysis with movable cathodes, but with such electrolysis the fastened material will grow on the electrodes (the cathodes), and with time they will become useless unless the separated metal is removed, for instance manually or in a automatical mechanical manner. Thus there has previously been performed electrolysis with sylindrical rotating cathodes where the separated metal is adhering on the outside of the electrode, and intermittantly must be removed so that the electrode will not become useless.

If the anode at such electrolysis is placed inside a rotatable, for instance cylindrical, cathode, it might be expected that the cathode gradually would grow solid and become useless from the deposited metal.

It has, however, surprisingly bee found that this does not occur if there is present a freely movable, solid medium inside the cathode drum. Such a freely movable medium may inter alia comprise metal particles or -spheres of the same metal as in the electrolyte, or of another conducting or non-conducting or inert material. By rotating the cathode, the particles will thus "polish" the inner surface of the cathode drum, and at the same time the distance between anode and the spheres will be less than between anode and cathode drum.

By using such a process and device for electrolysis, separated material will be deposited on the inner medium (spheres) and not on the cathode surface.

At the same time there will be mentioned "en passent" that the free, solid medium inside the cathode drum need not necessarily be round or sperical, but can have any shape which accomplishes the above mentioned effects, and which makes the metal deposit on the particle surface of the medium.

It will also in this connection be mentioned that the medium inside the the rotating or otherwise movable, f.ex. shaking or vibrating, cathode, also may comprise other devices, f.ex. scrapes or knives, which accomplishes a similar effect as the above mentioned solid medium.

By adding into the rotatable cathode an electrolyte, optionally containing free particles of solid medium, there may, by draining poor electrolyte from the opposite end of the cathode, be produced continuously metal particles or -silt without the cathode drum growing solid. This makes that it in addition becomes easy to remove possible harmful or interfering gas which has been produced during the electrolysis, by equipping the disclosed electrolysis drum with an outlet or a fan for such gas, or for gas which it may be advisable or necessary to store.

Examples of devices which are suited to performing the above disclosed electrolysis process will below be described by reference to the attached figures, where:

Figure 1:
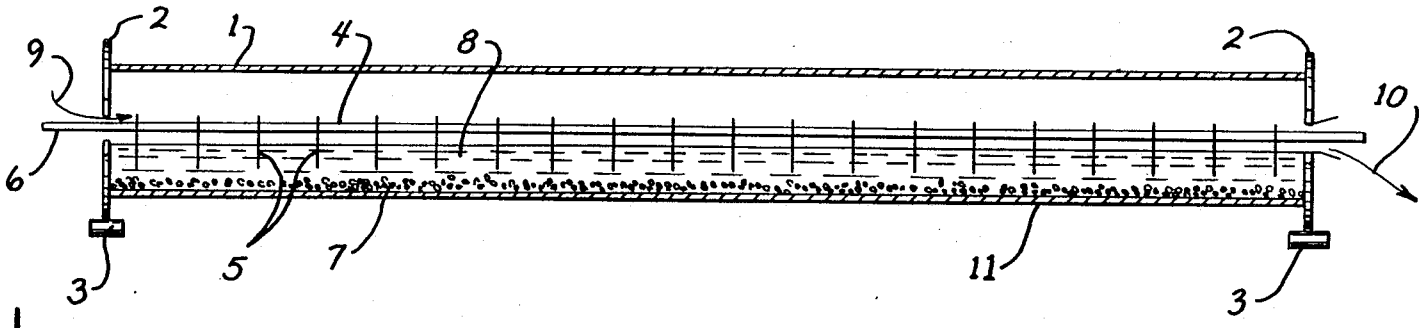
FIG. 1 shows a cathode drum with anode discs therein reaching down into the electrolyte.
Figure 2:
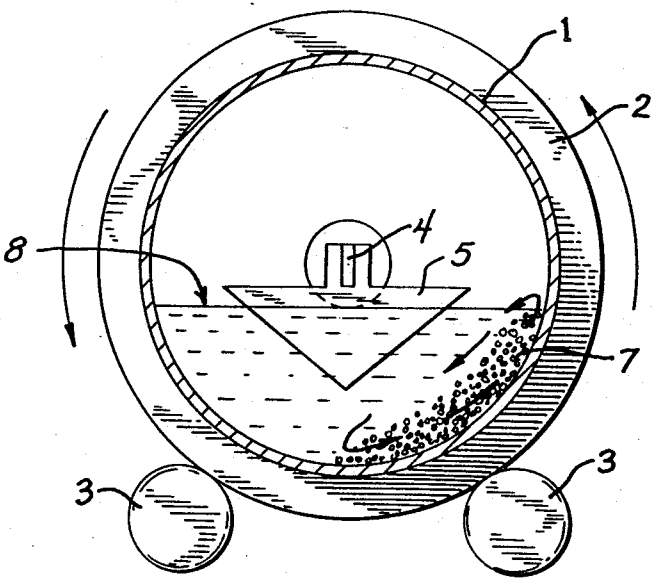
FIG. 2 shows a cathode drum as in FIG. 1, but seen from the side and with marked roll bearings.

A suited device for performing the electrolysis according to the present invention is shown in FIG. 1 and 2, wherein the rotating cathode drum 1 with electrically isolated end plates 2 is suspended on roll bearings 3. The penetrating anode comprises a conducting anode rod 4 with anode plates 5, optionally made of lead or some other siuted material, hanging down into the electrolyte. The anode rod is connected to a positive terminal of a not shown current source. The freely movable, particulate medium inside the rotatable end rotating cathode drum 1, is given by the reference number 7. The particle material does not have any direct contact with the anode plate 5. Inside the cathode drum 1 there exists an electrolyte 8, which electrolyte may be drained, optionally together with produced silt and/or waste material, through a drinage opening 10, where the elctrolyte which is drained at 10 is poor in the current cation which is being electrolysed. Electrolyte for electrolysis, and possibly containing particulate solid medium, is supplied at 9, and the drum cathode 1 is connected to a negative terminal of a not shown current scource at 11, f.ex. inter alia through a sliding connection. The direction of rotation for the cathode drum is given by outer arrows i FIG. 2, and the current movement of the particulate medium is given by inner arrows in FIG. 2.

Another possible embodiment of the device according to the invention, is where the side walls 2 are removed, and where the particulate material may migrate towards the open ends of the cathode drum 1, and from there be taken out during rotation or shaking/vibrating of the cathode drum.

Figure 3:
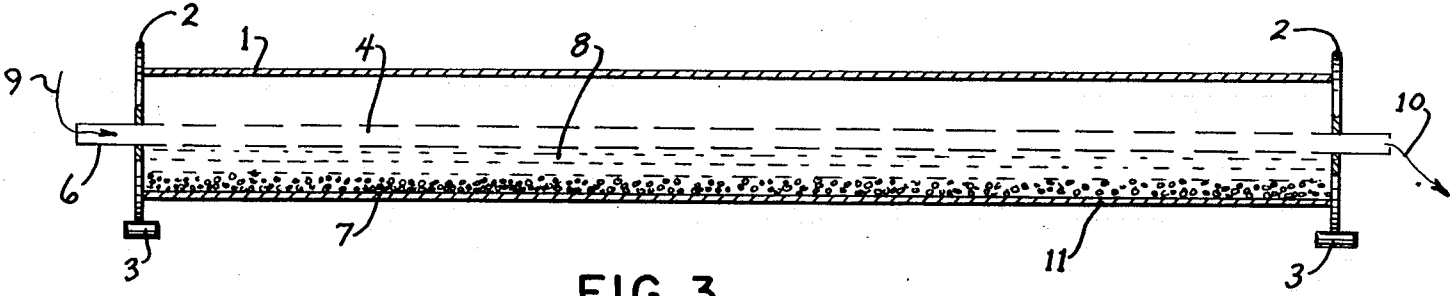
FIG. 3 shows another embodiment of a drum cathode which is shown in FIG. 1, but where the anode comprises an anode tube with holes for adding and discharging electrolyte and gasses.

Another embodiment of the device according to the present invention is depicted in FIG. 3, where each part is provided with the same reference numbers as in FIGS. 1 and 2, but where the anode does not encompass anode plates, but only a tube which is perforated, and where the electrolyte solution stands in direct contact with the tube 4. This embodiment makes it simple to remove produced gass by suction or blowing at 10.

Figure 4:
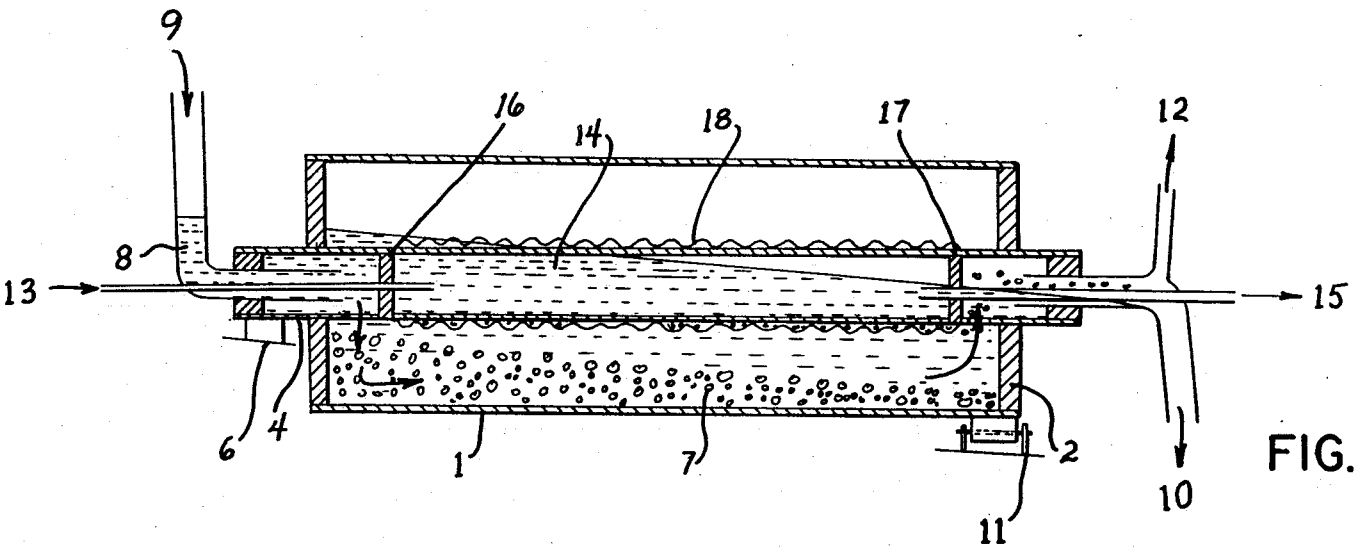
FIG. 4 shows an additional embodiment of a cathode drum, where the drum is placed obliquely for suitable sedimentation of the particle material, and where the anode tube is surrounded by a non-conducting sheet for refining electrolysis.

Yet another device for performing the process by electrolysis according to the invention is given in FIG. 4, wherein the anode tube 4 is perforated here as well, but where the middle anode section 16–17 is provided with a nonconducting cloth 18 and where this section 14 has separate supplying devices 13 and exit devices 15 for particulate material, silt and solutions. For persons skilled in electrolysis it will be close and obvious that such a device may be used for refining of metals or electrolysis where socalled red/ox-pairs are present, such as in f.ex. electrolysis of Cu I-cloride solutions (Cupro-solutions) where Cu II chloride is produced at the anode and may be suctioned through the cloth and out into the device 15, separately from the exit device of the cathode chamber 10. Produced gas, depicted by bubbles in the figure, is taken out through the outlet 12. Each reference number refers as well to the corresponding elements in the other figures. The cathode drum shown in FIG. 4, is in addition inclined to produce sedimentation of the particulate medium according to particle size, where the large particles collect in the lower part of the cathode drum, an may therefrom easily be removed.

Below some trials for productions of metal will be described by using the process according to the invention.

Experiment 1

The purpose for this experiment vas to determine the effect of the process according to the invention during production of metal, i.e. to determine whether metal did not deposit on the cathode walls but on the particulate material in the cathode drum only. The cathode drum (diameter=20 cm, length=100 cm, made of 316 L stainless steel) was filled with 4.00 kg Cu-spheres (so-called "prills") with a diameter of 3-5 mm, and approx. 9 1 electrolyte. (Intervals within which the particular general trial parameters lie, are: $H_2SO_4$—50-200 g/l, metal concentration —5-60 g/l in the inlet, temperature—25°-30° C. up to 70°-80° C., metal cations—$Cu^{2+}$, $Ni^{2+}$, $Zn^{2+}$, current density —50-2000 A/m$^2$,rotation of the cathode drum—1-20 rpm (corresponding to 1-20 cm/sek. periperally), weight of solid medium—1-10 kg (corresponding to 100-1000 kg/m$^3$).)

The anode comprised in this trial 19 lead anode plates with a mutual distance of 5 cm inside the cathode drum. The electrolysis device was mounted on rolls, and a variable motor rotated the drum with 17 rpm while the anode was stationary. The device was heated by help of heating cables placed around the drum (2×400 W) and received their energy via two sliding contacts of 220 V. A contact thermostate regulated the temperature with 5° C. accuracy.

The positive end of a rectifier was connected to the anode rod which protruded from openings in the end walls of the cathode drum. The negative pole was connected to a 5 mm lead plate which slided against the rotating cylinder and was kept in place by a spring, somehting which gave good contact without tendencies to spark production. The system coud withstand 200 A. Elelctrolyte was supplied through the one end of the cathode drum, and drained from the other end. Current was supplied when the working temperature was reached while the drum rotated continously. Continous repacement of the particulate medium was not performed in htis experiment, and the particles were allowed to grow. The experiment was done during 9½ hours at only 25°-28° C. by using 60 A. This gave a current density of 240 A/m$^2$ at a cell voltage of 2.8 V.

The results of the experiment are given in table 1. By these operating conditions there was produced 0,3 kg copper deposited on the copper spheres in the solid medium in the cathode drum only. The drum walls per se were completely clean for copper deposits.

TABLE 1

| | $Cu^{2+}$ | $H_2SO_4$ | Electrolyte supply | Temp. |
|---|---|---|---|---|
| Supplied the cell | 3,3 g/l | 44 g/l | 9.6 l/h | — |
| Drained | 0.1 g/l | 92 g/l | 9.6 l/h | 28° C. |

During the experiment there was also produced hydrogen, but this was effectively removed by suction. The trial shows that metal is deposited on the solid medium only.

Experiment 2

The same prcedure as in experiment 1 was used, but with increased temeperature and a supply to the cell of 32 g/l copper and a drainage from the cell of 5 g/l copper to determine whether the solid medium (the copper spheres, "prills") still were produced at increased copper concentrations without deposits of copper on the drum walls at 50° C. The results are given in table 2. At the trials, the cell voltage=2.4 V, Current density=240 A/m$^2$, Duration=37 hours, Current efficiency=70%. There was produced 1.8 kg metal on the solid medium alone.

TABLE 2

| | $Cu^{2+}$ | $H_2SO_4$ | Electrolyte supply | Temp. |
|---|---|---|---|---|
| Supplied the cell | 32.0 g/l | 176 g/l | 1.74 l/h | — |
| Drained | 5-7 g/l | 260-270 g/l | 1.41 l/h | 50° C. |

Experiment 3

The same procedure as in experiment 1 was used, except that this experiment was a copy of a true electro extraction procedure for copper, where the feed electrolyte is approx. 60 g/l Cu and the drainage is 30-40 g/l Cu at 55°-60° C. The operating conditions were: Cell voltage=2.7 V, Current density=240 A/m$^2$, Duration=18 hours, Current efficiency=55% (on account of $Fe^{3+}$). There was at the trial produced 0.70 kg copper deposited on the medium material (the copper spheres) alone. The operating conditions are given in table 3. The trial shows that the process according to the invention may be used under usual conditions for electro production of metal.

TABLE 3

| | $Cu^{2+}$ | $Fe^{3+}$ | $H_2SO_4$ | Electrolyte supply | Temp. |
|---|---|---|---|---|---|
| Supplied the cell | 58 g/l | 2 g/l | 64 g/l | 1.5 l/h | — |
| Drained | 35 g/l | 2 g/l | 107 g/l | 1.4 l/h | 55-60° C. |

Experiment 4

The same procedure as in experiment 1 was used, except that the current density was increased to 800 A/m$^2$, while the temperature was kept to 55°-60° C. with a supply of 32 g/l Cu. (The cell current=200 A, no iron in the supplied material.) The operating conditions are given in table 4. There was produced 0.66 kg copper which was deposited on the copper medium in the drum alone. The trial was performed with cell voltage=3.3 V, Current density 800 A/m$^2$, duration=4 hours, current efficiency=70%.

TABLE 4

| | $Cu^{2+}$ | $H_2SO_4$ | Electrolyte supply | Temp. |
|---|---|---|---|---|
| Supplied the cell | 32,4 g/l | 80 g/l | 5.2 l/h | — |
| Drained | 0.1-0.4 g/l | 140 g/l | 4.8 l/h | 55-60° C. |

In connection with experiment 4 it is of interest to observe that the minimum content of metal ions in the drainage is 0.1-0.4 g/l. This shows that the efficiency of the process and with the device according to the present invention, is strongly improved compared to previous technique in the field.

Experiment 5

The same procedure as in experiment 1 was used, except that the quantity of copper spheres ("prills") was increased from 4.00 kg to 8.00 kg, and the feed electrolyte from experiment 4 was doped with small quantities of antimony (Sb) and arsenic (As) to determine the selectivity of the deposition of copper against antimony and arsenic.

The trial was performed with a cell voltage of 3.0–3.6 V, current density=800 A/m$^2$, duration=3 hours, temperature=60° C., feed velocity of solution=3.3 l/h, current=200 A. The trial conditions an -results are given in table 5.

Experiment 5 shows as in experiment 4 that the drained solution contains very little metal ions, and that the selectivity for depositing copper against antimony and arsenic is very good.

TABLE 5

| | $Cu^{2+}$ | $H_2SO_4$ | $Fe^{2+}$ | Sb | As |
|---|---|---|---|---|---|
| Supplied the cell | 27,3 g/l | 171 g/l | 1,4 g/l | 90 mg/l | 8 mg/l |
| Time | | | | | |
| 5 min drain | 28,7 g/l | | | 85 mg/l | 8 mg/l |
| 30 min drain | 20,7 g/l | | | 85 mg/l | 8 mg/l |
| 60 min drain | 9,7 g/l | 186 g/l | | 85 mg/l | 8 mg/l |
| 90 min drain | 3,6 g/l | | | 85 mg/l | 9 mg/l |
| 105 min drain | 0,75 g/l | | | 85 mg/l | 9 mg/l |
| 120 min drain | 0,13 g/l | | 1,6 g/l | 59 mg/l | 7 mg/l |
| 135 min drain | 0,13 g/l | 203 g/l | | 34 mg/l | 4 mg/l |

In this connection it is interesting to observe that the present invention opens for possibilities for use over and above only electro production and electro refining of metal such as f.ex. inter alia purification of electrolytes.

Experiment 6

The same procedure as in experiment 4 was used, except that the solid medium inside the cathode drum was changed from copper spheres ("prills") to small bits (5×5×10 mm) of stainless steel (316 L), the same material that the drum was made of. The trial conditions are given in table 6. During the trial there was deposited on the steel bits a copper layer in a quantity of 0.36 kg simultaneously as there was produced copper dust in a quantity of 0.47 kg. There was neither in this experiment deposited any copper on the walls of the cathode drum. The trial was performed with cell voltage=3.9 V, current density=800 A/m$^2$, duration=5.1 hours, current efficiency=70%.

TABLE 6

| | $Cu^{2+}$ | $H_2SO_4$ | Electrolyte supply | Temp. |
|---|---|---|---|---|
| Supplied the cell | 32,4 g/l | 145 g/l | 5,5 l/h | — |
| Drained | 0,4–0,6 g/l | 210 g/l | 5,1 l/h | 55–60° C. |

The trial shiws that the medium in the cathode drum needs to be present, but may be of a different material than the metal which is to be separated. This prevnets all the same depositing of material on the drum walls.

Experiment 7

The same procedure as in experiment 4 was used, except that the solid medium inside the cathode drum was replaced with ground rock (−25±4 mm). This was performed to determine whether an inert medium (not electrically conducting) would prevent deposit on the walls of the cathode drum. The trial conditions are given in table 7. At the trial there was deposited the main part (approx. 450–500 g Cu) on the inside of the drum walls, while there was found 0.10 g copper particles in the solid medium in the drum. The trial was performed with cell voltage=5–6 V, current density=800 A/m$^2$, duration=3,6 hours.

TABLE 7

| | | | Electrolyte supply | Temp. |
|---|---|---|---|---|
| Supplied the cell | 32,0 g/l | 145 g/l | 5,5 l/h | — |
| Drained | 1–3 g/l | 206 g/l | 5,0 l/h | 60–70° C. |

The above given experiments show that if the conditions are right (e.g. metal concentration, temperature, stirring, current density etc.) in the cathode, an electrically conducting medium alone inside the cathode drum will effectively prevent deposition of metal on the drum walls. If the conditions by the electrolysis however favours silt/particle deposition (e.g. generally low metal concentration, low temperature, high current density and reduced stirring), the solid medium works as a mechanical grinder, and it makes no difference whether the medium is electrically conducting or not. It is preferred that the solid medium should be of the same character as the metal which is removed from the electrolyte. The process and device according to the invention can accordingly advantageously be used for purification purposes during use of low current density.

I claim:

1. Device for performing an electrowinning process comprising a rotatable drum cathode (1) being connected to a current scource, characterized in a device having supply and exhaust conduites (9,10) for introducing fresh electrolyte and removing lean electrolyte, and an anode arrangement (4,5) positioned inside the cathode drum (1), the drum having end walls (2) electrically isolated from the rest of the drum (1) and the anode arrangement having anode baffle plates (5) disposed at intervals along the length of the drum (1).

2. Device according to claim 1, characterized in that the device additionally comprises means (15) for removing particulated cathode material continuously.

3. Device according to claim 2, characterized in that the device for removing the particulate cathode material is a scoop discriminating for size of the particles of the particulate cathode material (7).

4. Device according to claim 1, characterized in that the top edge of the anode baffle plates (5) rise above the electrolyte (8) to provide a tortuous path for the electrolyte (8) inside the cathode drum (1).

5. Device according to claims 1, 2 or 4 characterized in that the device in addition comprises a device (12) for venting off gass produced at the electrodes during the electrowinning.

6. Device according to claim 5, characterized in that the venting device (12) comprises a fan.

* * * * *

UNITED STATES PATENT AND TRADEMARK OFFICE

CERTIFICATE OF CORRECTION

PATENT NO. : 4,954,234

DATED : 9-4-90

INVENTOR(S) : Thomas Thomassen

It is certified that error appears in the above-identified patent and that said Letters Patent is hereby corrected as shown below:

Claim 1, Col. 6, Line 37:
Delete "scource" and substitute therefore -- source --.

Claim 1, Col. 6, Line 38:
Delete "conduites" and substitute therefore -- conduits --.

Claim 5, Col. 6, Line 59:
Delete "gass" and substitute therefore -- gas --.

Signed and Sealed this

Twenty-fourth Day of December, 1991

*Attest:*

HARRY F. MANBECK, JR.

*Attesting Officer*

*Commissioner of Patents and Trademarks*